US008413730B2

(12) United States Patent
Gette et al.

(10) Patent No.: US 8,413,730 B2
(45) Date of Patent: Apr. 9, 2013

(54) WELLHEAD ASSEMBLY WITH TELESCOPING CASING HANGER

(75) Inventors: Nicholas P Gette, Houston, TX (US); Ryan Herbel, Houston, TX (US); John Nelson, Houston, TX (US); Armando Faz, Houston, TX (US); Detrick Garner, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 88 days.

(21) Appl. No.: 12/956,723

(22) Filed: Nov. 30, 2010

(65) Prior Publication Data

US 2012/0132441 A1 May 31, 2012

(51) Int. Cl.
*E21B 23/01* (2006.01)
*E21B 33/04* (2006.01)

(52) U.S. Cl. ..... 166/382; 166/368; 166/75.14

(58) Field of Classification Search ..... 285/317, 285/145.4, 920, 922; 166/360, 368, 85.1, 166/75.14, 208, 214, 217, 382
See application file for complete search history.

(56) References Cited

U.S. PATENT DOCUMENTS

| | | | | | |
|---|---|---|---|---|---|
| 3,147,992 | A * | 9/1964 | Haeber et al. | 285/18 |
| 3,193,308 | A * | 7/1965 | Todd | 285/18 |
| 3,893,717 | A * | 7/1975 | Nelson | 285/3 |
| 4,460,042 | A * | 7/1984 | Galle, Jr. | 166/217 |
| 4,528,738 | A | 7/1985 | Galle, Jr. | |
| 4,540,053 | A * | 9/1985 | Baugh et al. | 166/348 |
| 4,550,782 | A * | 11/1985 | Lawson | 166/382 |
| 4,751,968 | A * | 6/1988 | Ames et al. | 166/368 |
| 4,757,860 | A * | 7/1988 | Reimert | 166/208 |
| 4,765,402 | A * | 8/1988 | Smith, Jr. | 166/115 |
| 4,836,579 | A * | 6/1989 | Wester et al. | 285/3 |
| 4,883,121 | A * | 11/1989 | Zwart | 166/217 |
| 4,909,546 | A | 3/1990 | Nobileau | |
| 5,070,942 | A * | 12/1991 | McInnes | 166/115 |
| 5,318,117 | A * | 6/1994 | Echols, III et al. | 166/114 |
| 5,370,186 | A * | 12/1994 | Ireland | 166/297 |
| 6,510,895 | B1 * | 1/2003 | Koleilat et al. | 166/208 |
| 7,150,323 | B2 * | 12/2006 | Ford | 166/348 |
| 7,380,607 | B2 | 6/2008 | Thomas | |
| 7,441,594 | B2 * | 10/2008 | Vanderford et al. | 166/75.14 |
| 7,854,266 | B2 * | 12/2010 | Watson | 166/380 |
| 2003/0192704 | A1 * | 10/2003 | Ford et al. | 166/377 |
| 2004/0238185 | A1 * | 12/2004 | Rothers et al. | 166/382 |

(Continued)

FOREIGN PATENT DOCUMENTS

| | | |
|---|---|---|
| GB | 860914 A | 2/1961 |
| GB | 2208123 A | 3/1989 |

OTHER PUBLICATIONS

GB Search Report dated Feb. 9, 2012 from corresponding Application No. GB1120221.5.

*Primary Examiner* — Kenneth L Thompson
*Assistant Examiner* — Wei Wang
(74) *Attorney, Agent, or Firm* — Bracewell & Giuliani LLP

(57) ABSTRACT

A wellhead housing has a telescoping casing hanger with an actuator mechanism to provide for direct transfer of casing and pressure loads to the housing. The transfer of casing and pressure loads occurs even in conditions where the telescoping casing hanger may be set in a high position in the wellhead housing on a load shoulder. The transfer of casing and pressure loads also occurs in conditions where the telescoping casing hanger may be set in an earlier installed casing hanger in the wellhead housing for a larger diameter casing string.

18 Claims, 9 Drawing Sheets

U.S. PATENT DOCUMENTS

2005/0252653 A1* 11/2005 Vanderford et al. ..... 166/75.14
2008/0164693 A1* 7/2008 Weems et al. ..... 285/317
2010/0078178 A1* 4/2010 Watson ..... 166/380
2010/0089590 A1* 4/2010 Dyson et al. ..... 166/382

* cited by examiner

WELLHEAD ASSEMBLY WITH TELESCOPING CASING HANGER

BACKGROUND OF THE INVENTION

1. Field of the Invention

The present invention relates in general to subsea wellhead assemblies, and in particular to a wellhead housing, wherein an actuator mechanism causes the load on a casing hanger in the wellhead housing to be transferred to the housing even in the event the casing hanger may be set in a high position in the wellhead housing.

2. Description of the Prior Art

In a typical subsea well, wellhead housing is positioned on the floor of a body of water at the upper end of the well. The wellhead housing is a tubular member having a bore aligned with the well bore. A string of large diameter casing attaches to the lower end of the wellhead housing and extends into the well bore. After further drilling into the earth through the wellhead housing, a smaller diameter string of casing is installed. A casing hanger at the upper end of the smaller diameter string of casing is landed in the bore on a load shoulder in the wellhead housing.

Debris and cuttings from the well are a continuing concern in subsea wellhead equipment design and operation. The debris and cuttings can become lodged or located between the casing hanger and other load bearing structure in the wellhead, such as another casing hanger in a stack in the wellhead housing or the wellhead housing itself. Thus, there were concerns with proper seating of casing hangers for load transfer or sharing purposes. The problem became worse when several hangers were stacked on top of each other, as was typical in subsea wellheads.

For the uppermost, stacked hangers, the use of shim sets with adjustable shims was contemplated. Adjustments were to be made after appropriate measurements were made in the wellhead housing at the wellhead to determine the required amount of adjustment. However, a separate trip of equipment from the surface to the wellhead was required which was time consuming and thus expensive. There was also concern expressed about the ability to make accurate measurements to determine the required adjustment.

SUMMARY OF THE INVENTION

Briefly, the present invention provides a new and improved wellhead assembly, having wellhead housing with a bore and an installed casing hanger in the bore. The wellhead housing has a support shoulder adjacent the bore and a telescoping casing hanger for securing to a string of casing and lowering into the wellhead housing. A split, resilient load ring is carried in a retracted initial position on the casing hanger. The load ring is movable outwardly to a set position in engagement with the wellhead housing. An actuator is mounted with the casing hanger below the load ring for moving the load ring from the initial position to the set position. The actuator includes a resilient mechanism for adjusting for height variations between the position of the load ring and the support shoulder during movement of the load ring to the set position to land the telescoping casing hanger in the wellhead housing.

The present invention further provides a new and improved method for installing a telescoping casing hanger atop an installed casing hanger in a bore of wellhead housing at the upper end of a well in a body of water. A support shoulder is provided in the bore of the wellhead housing. A split, resilient load ring is mounted in a recessed initial position in the telescoping casing hanger. An actuator is mounted on the telescoping hanger below the load ring, and then a string of casing is secured to the telescoping casing hanger and the telescoping casing hanger lowered into the wellhead housing. The telescoping hanger is landed on the installed casing hanger. The load ring is activated with the actuator and moved to expand and land on the support shoulder of the wellhead housing, and the casing hanger lands on the load ring. The position of the load ring on the support shoulder is adjusted to compensate for differences in the landed height of the telescoping hanger and the installed casing hanger.

DETAILED DESCRIPTION OF THE PREFERRED EMBODIMENTS

Figure 1:
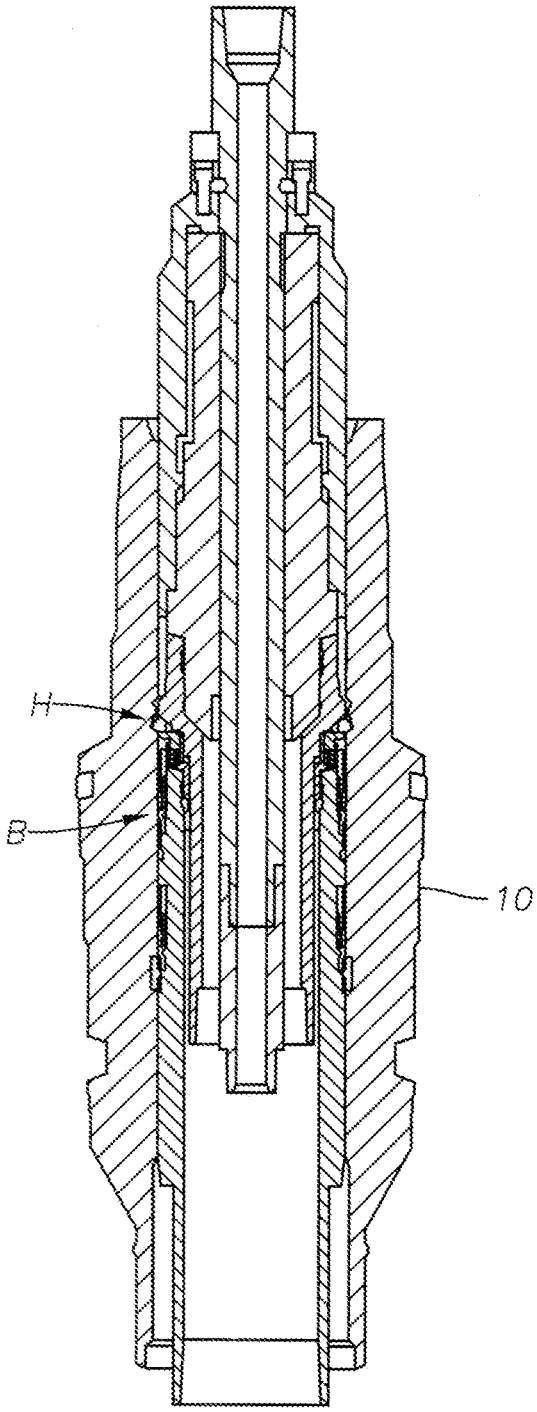
FIG. 1 is a vertical sectional view of a portion of a wellhead housing having a telescoping casing hanger according to the present invention located in a landed position.
Figure 2:
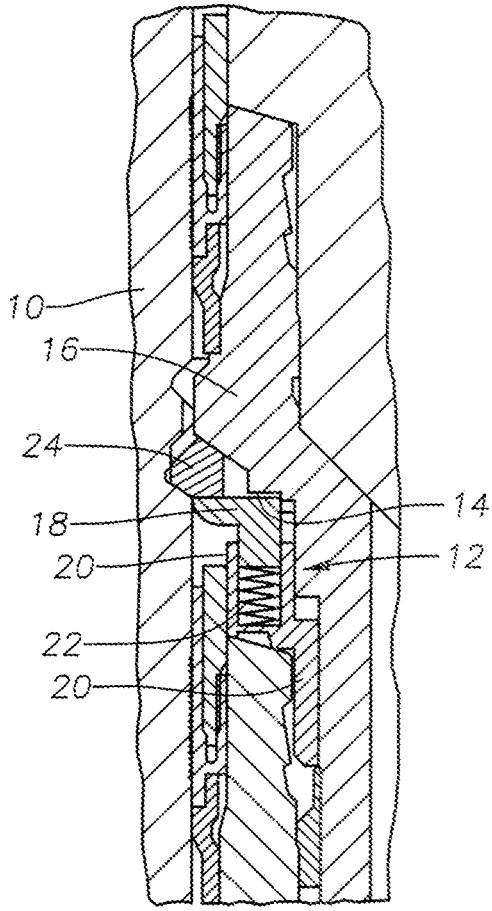
FIG. 2 is an enlarged view of a portion of the structure circled and identified by reference numeral 2 in FIG. 1.
Figure 3:
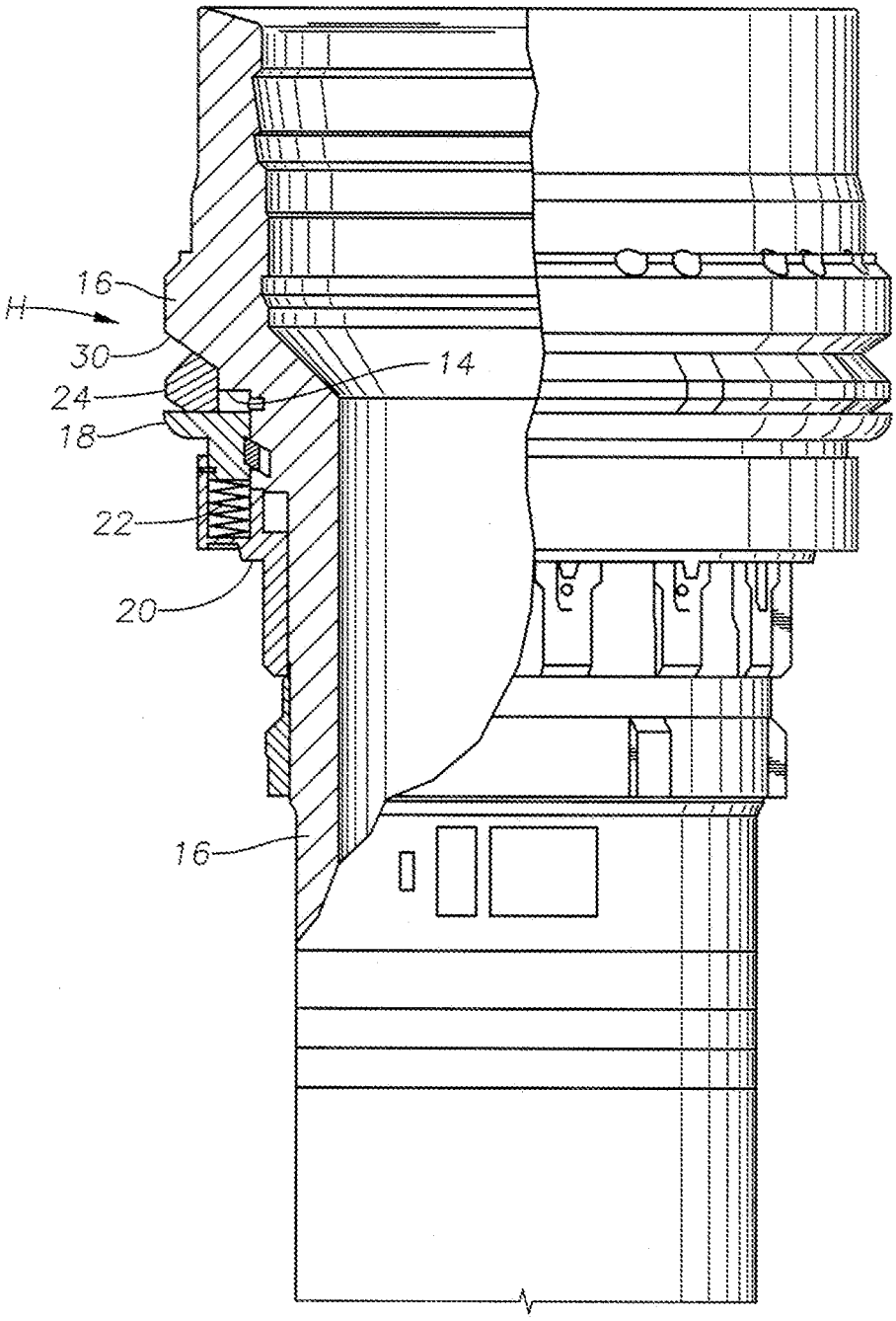
FIG. 3 is an enlarged view taken partly in vertical section of the portion of the telescoping casing hanger of FIG. 1.
Figure 4:
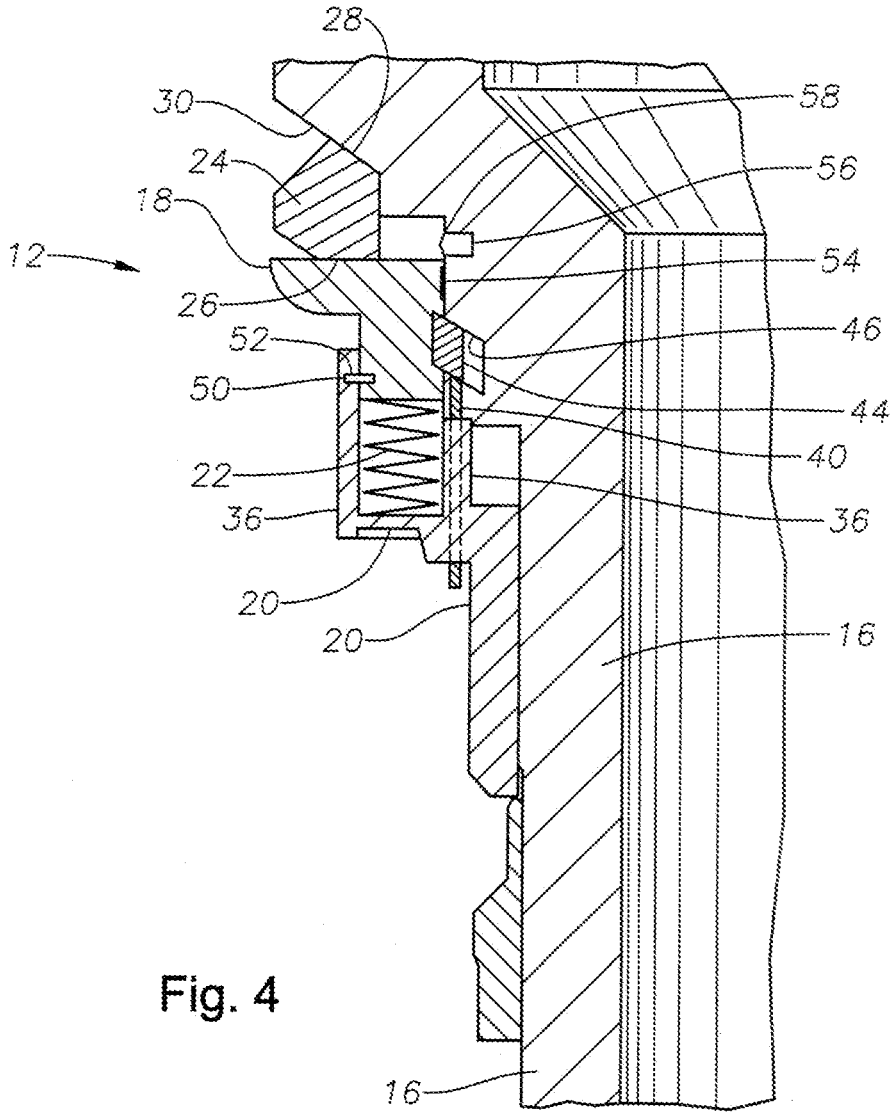
FIG. 4 is an enlarged view of a portion of the structure circled and identified by reference numeral 4 in FIG. 3.

In the drawings, a telescoping casing hanger H according to the present invention is shown (FIG. 1) landed on a previously installed hanger such as a bridging hanger B in a wellhead housing 10. The wellhead housing 10 is of the conventional type installed as a component of a subsea wellhead assembly located at the sea floor. The telescoping casing hanger H includes an activation ring 12 which is mounted extending circumferentially below a collar or shoulder 14 of the body 16 of the telescoping casing hanger H. The activation ring 12 takes the form of an upper activation ring sleeve member 18 (FIG. 4), a lower activation ring sleeve member 20 and a compressible spring 22. A wave spring is suitable form of spring for the spring 22, although others might be used.

A load ring 24 is mounted on an upper surface 26 of the upper activation ring member 18 extending circumferentially about the casing hanger body 16 between the shoulder 14 and the activation ring 12. The load ring 24 is a split, resilient ring and adapted to transfer load from the casing hanger H to the wellhead housing. The load ring 24 has a tapered upper inner surface 28 adapted for engagement with and relative sliding movement with respect to a corresponding tapered circumferentially extending lower surface 30 of the casing hanger body 16.

Figure 5A:
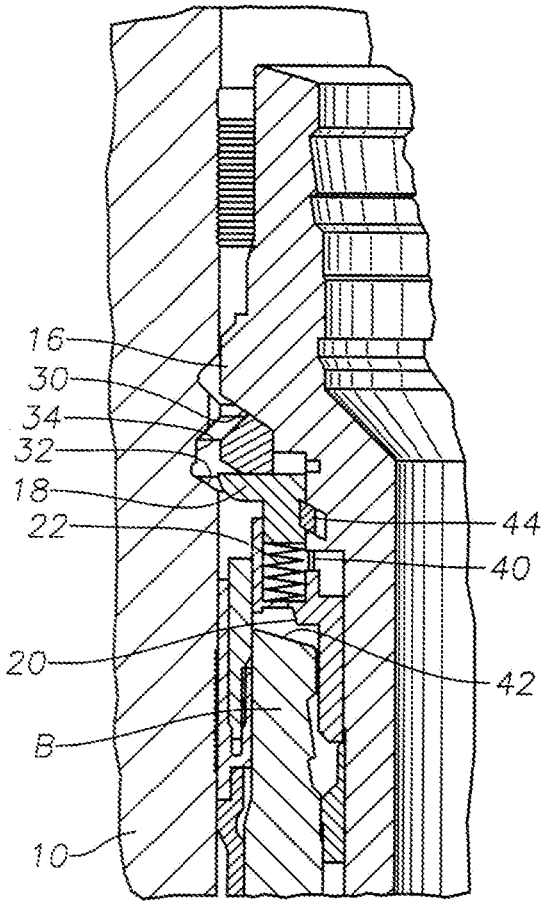
FIGS. 5A, 5B, 5C and 5D are vertical sectional views of the structure of FIG. 4 during an activation sequence of landing the telescoping casing hanger of the present invention in normal landed position.
Figure 5B:
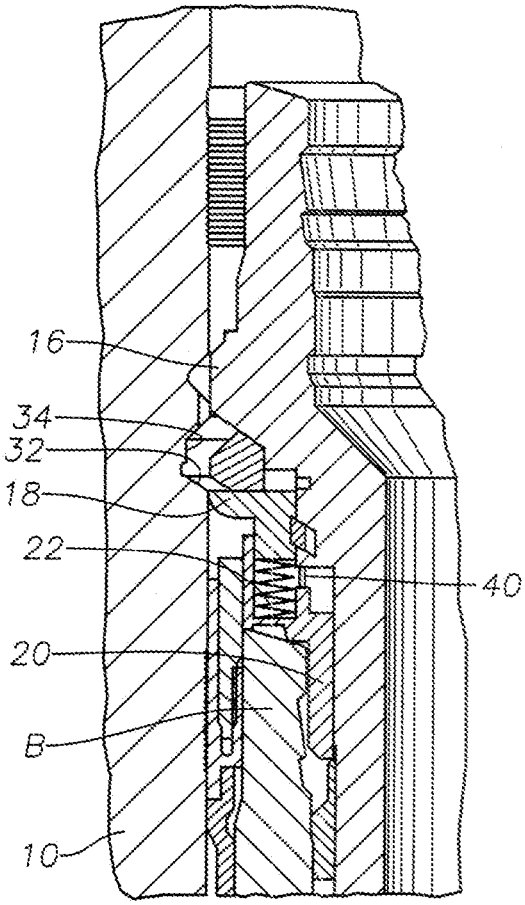

Referring to FIG. 5A, the load ring 24 is moved inwardly and outwardly with respect to a load transfer landing shoulder 32 formed in an annular groove or bore 34 extending about the interior of the wellhead housing 10 to land the casing hanger H in the wellhead housing 10 Such movement takes place during the landing and extraction or pulling of the casing hanger H in the wellhead housing 10.

Referring again to FIG. 4, activation ring 12 also includes an outer collar 36 mounted on an outer surface of the lower activation ring member 20. A set of circumferentially disposed pins 40 are mounted with the collar 36 extending downwardly for engagement an upper portion 42 (FIG. 5A) of a previously installed casing hanger, such as bridging hanger B, in the wellhead housing 10.

The telescoping casing hanger H includes a lock ring 44 with circumferentially extending outwardly inclined surfaces. The lock ring 44 is mounted for movement within a circumferential slot 46 formed between correspondingly inclined surfaces formed extending circumferentially about the casing hanger body 16 adjacent the upper activation ring member 18.

When the casing hanger H is being lowered or tripped into the well bore, the lock ring 44 prevents the activation ring 12 from moving if prematurely contacted. This in turn prevents the load ring 24 from early movement. In this way, the casing hanger H is not damaged during movement in the well bore as a result of premature operation of activation ring 12 caused by contact with obstructions which might be encountered in the well bore.

A snap ring 50 is mounted in a corresponding slot 52 extending circumferentially about a lower outer portion of the activation ring member 18. The snap ring 50 is fitted into the slot 52 and extends outwardly to engage a lip formed in an inner side of the lower activation ring member 20. The snap ring 50 in the preloaded position shown in FIG. 4 captures the spring 22 and maintains the spring 22 in a preloaded state so that a large axial force is required to telescopically collapse the activation ring 12.

The activation ring 12 also includes one or more circumferentially extending ratchet lip or rim members 54 on its upper inner surface adjacent the casing housing body 16. The ratchet member structure 54 extends downwardly and is adapted to engage an overpull check ring 56. The overpull check ring 56 includes an outwardly extending lip 58 extending about the casing hanger body 16 above the upper activation ring member 18. Overpull check ring 56 is mounted in a circumferentially extending recess or groove formed in the casing housing body member 16.

Figure 5C:
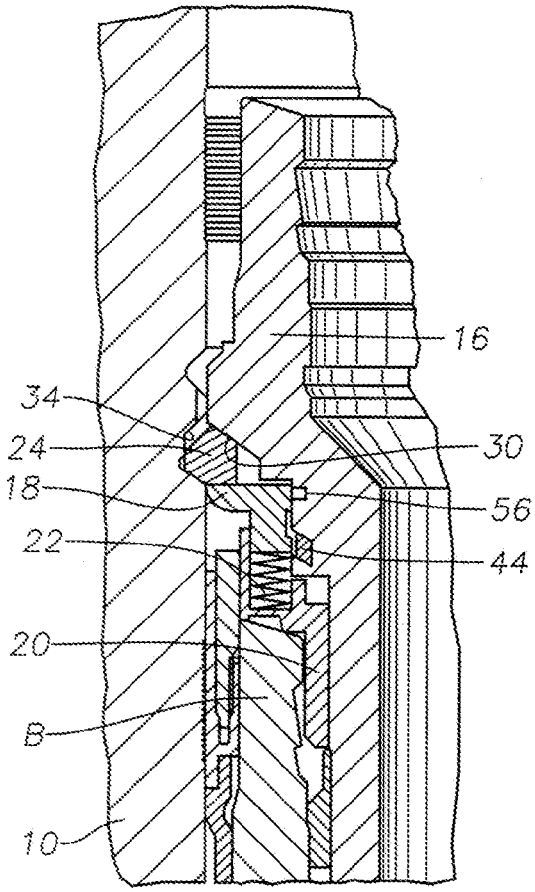
Figure 5D:
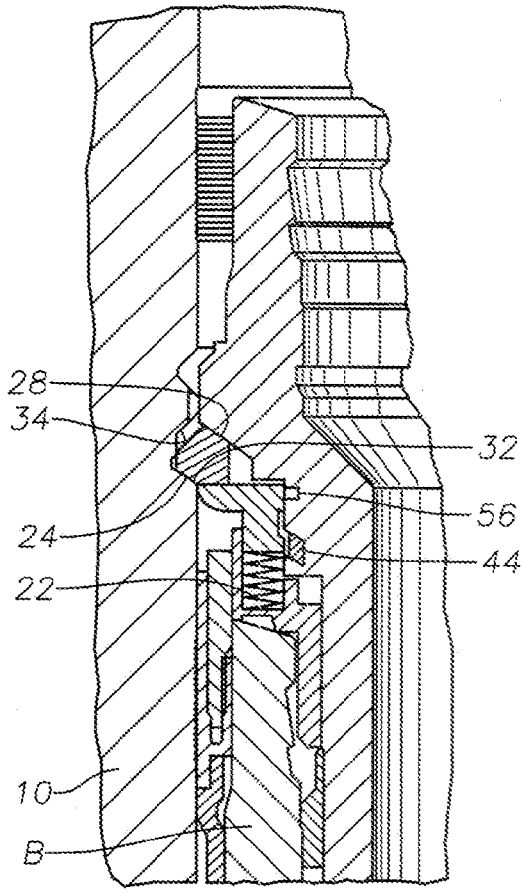

The overpull check ring 56 due to this location engages and locks the upper activation member 18 only when the load ring 24 has fully expanded (FIGS. 5C and 5D). This allows an operator to make an overpull once the casing hanger has landed. As will be set forth, the overpull check ring 56 thus permits verification or confirmation that the telescoping casing hanger 16 is properly landed in the wellhead housing 10 and the load transferring mechanisms have properly functioned.

In the operation of the present invention, an activation sequence in situations when the casing H is landed at its intended normal height position on the previously installed hanger B in the wellhead housing is illustrated in FIGS. 5A through 5D. The casing hanger H and associated casing suspended beneath it is lowered through a riser downwardly into the wellhead housing 10. The pins 40 (FIG. 4) come into contact with the structure of the previously installed hanger. The pins 40 are pressed upwardly into the body of the casing hanger H (FIG. 5A) forcing the lock ring 44 to retract (FIG. 5C) and unlock the upper activation member 18. Further displacement of the casing hanger H downwardly (FIG. 5C) occurs as a result of slacking off casing weight.

Further weight downwardly on the casing hanger H collapses the wave spring 22 of the casing hanger H and causes outward expansion of the load ring 24 until contact is made with the bore 34 of the wellhead housing 10, thus limiting further outward expansion. The load ring 24 is now fully set (FIG. 5D) and the casing hanger H is in position for load transfer purposes. The preload on the spring 22 captured by the activation ring 12 is at a force level greater than the maximum expansion load on the load ring 24 to permit this to occur.

Figure 6A:
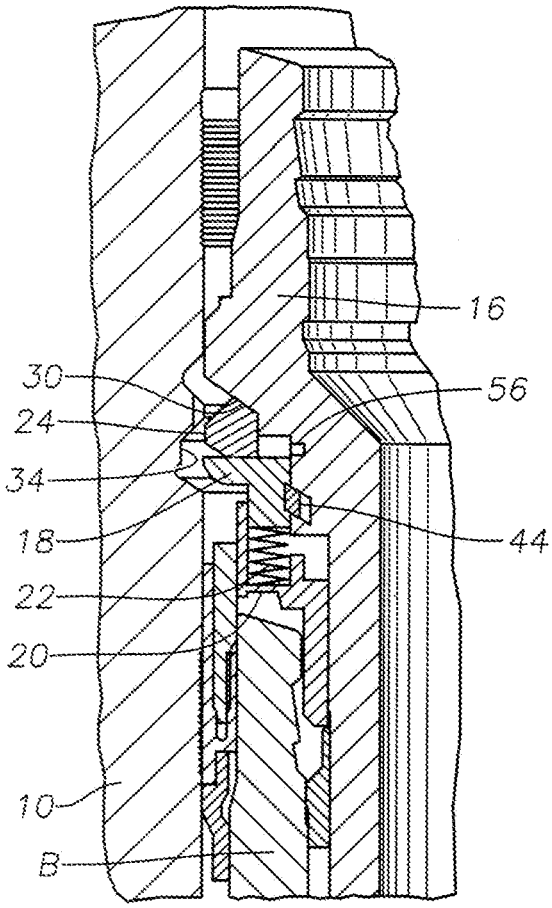
FIGS. 6A, 6B, 6C and 6D are vertical sectional views of the structure of FIG. 4 during an activation sequence of landing the telescoping casing hanger of the present invention in a higher than normal landed position.
Figure 6B:
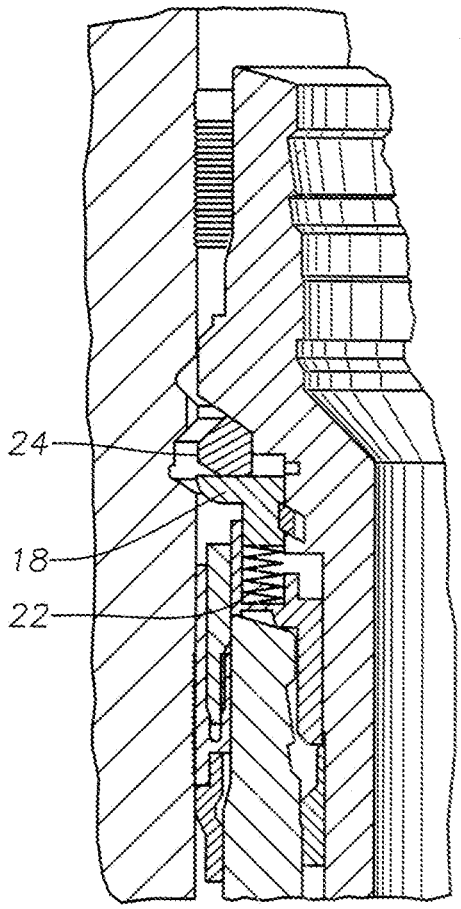

FIGS. 6A through 6D illustrate an activation sequence in the event that the hanger B below the casing hanger H is sitting at a higher than normal position due the presence of cuttings or other debris. By comparison of FIGS. 6A through 6D with FIGS. 5A through 5D it can be seen that the load ring 24 in FIGS. 6A and 6B is at a higher position with respect to the bore 34 of the wellhead housing 10 than in FIGS. 5A and 5B. The pins 40 come into contact and are pressed upwardly into the body of the casing hanger H (FIG. 6A). Activation of pins collapses internal lock ring 44, unlocking upper activation member 18 from casing hanger body 16.

Figure 6C:
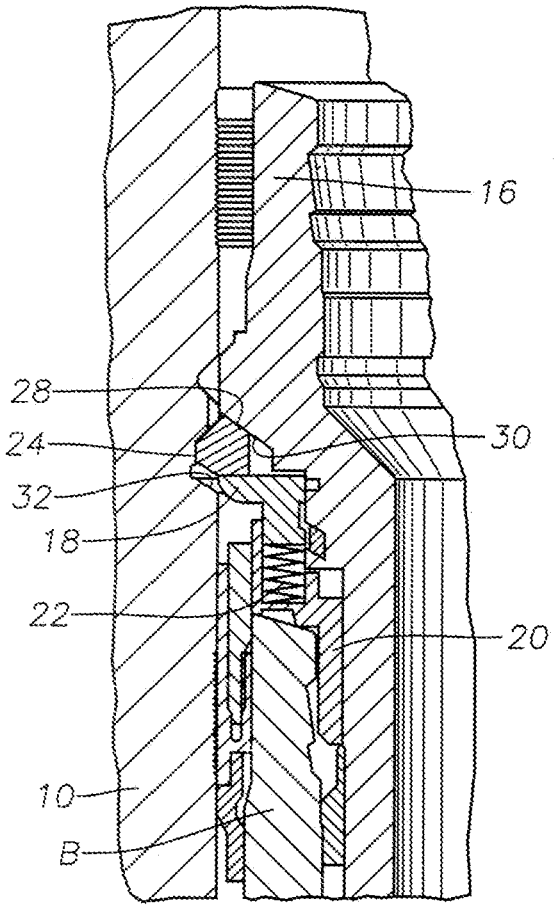

Load ring 24 expands load ring until it contacts housing wall (FIG. 6C). Casing hanger shoulder 28 and upper activation member 18 expand the load ring 24 until it contacts the inner wall of the wellhead housing 10 (FIG. 6C), at a higher position than illustrated in FIG. 5C.

Figure 6D:
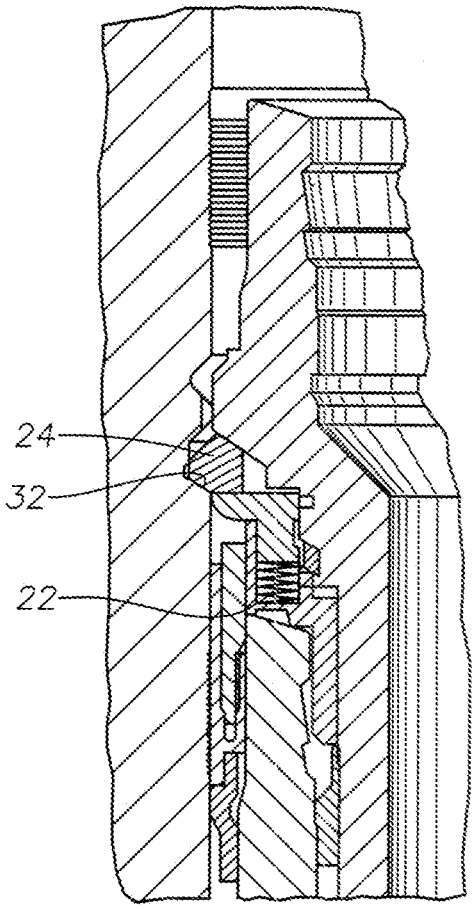

Further weight applied downwardly by slacking casing weight on the casing hanger in the position illustrated in FIG. 6C collapses the wave spring 22 and load ring 24 is now fully set (FIG. 6D). It can be seen that the casing hanger H in FIG. 6D is also now at the fully landed normal height position shown in FIG. 5D.

Figure 7A:
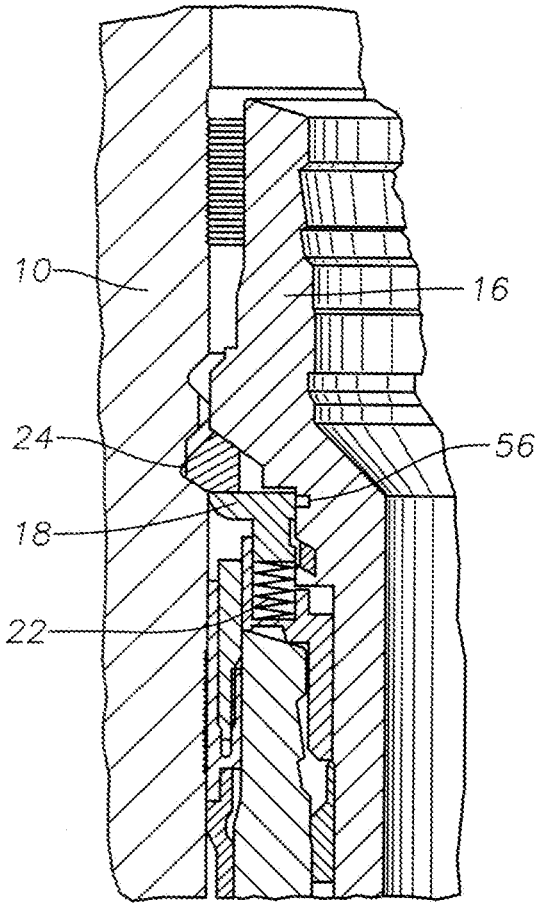
FIGS. 7A and 7B are vertical sectional views of the structure of FIG. 4 during a sequence of confirming proper landing of the telescoping casing hanger of the present invention.

The sequence of events described above occurs sequentially and seamlessly and requires only the slacking off of casing weight in order to take place. As has been set forth the presence of the overpull check ring 56 which is engaged with the activation member 18 (FIG. 7A) allows the operator to confirm (FIG. 7B) that proper landing has occurred by making an overpull on the installed assembly.

Figure 7B:
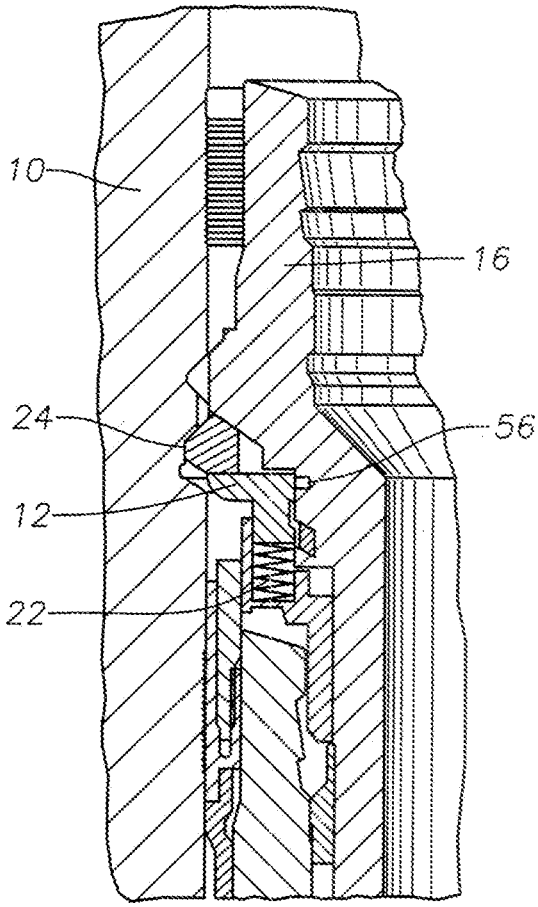
Figure 7C:
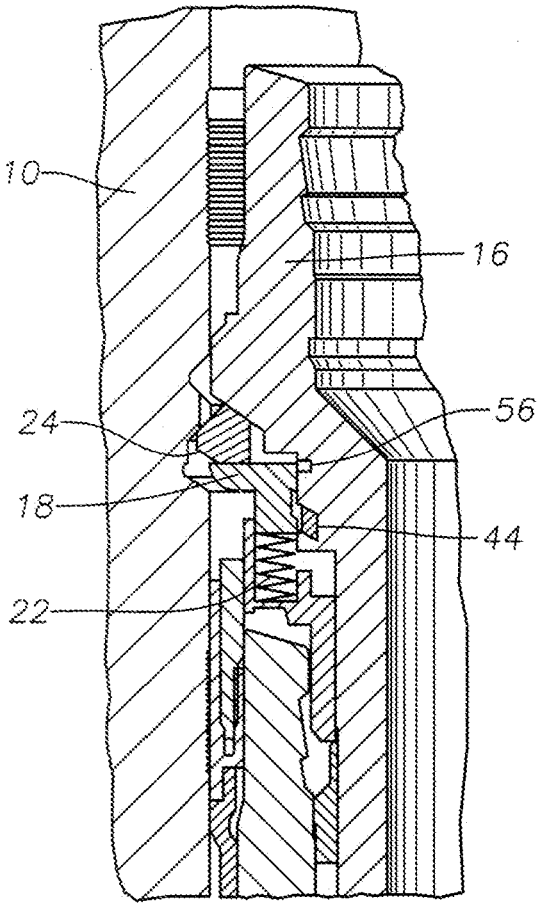
FIGS. 7C and 7D are vertical sectional views of the structure of FIG. 4 during a deactivation sequence of retrieving or pulling the telescoping casing hanger of the present invention.
Figure 7D:
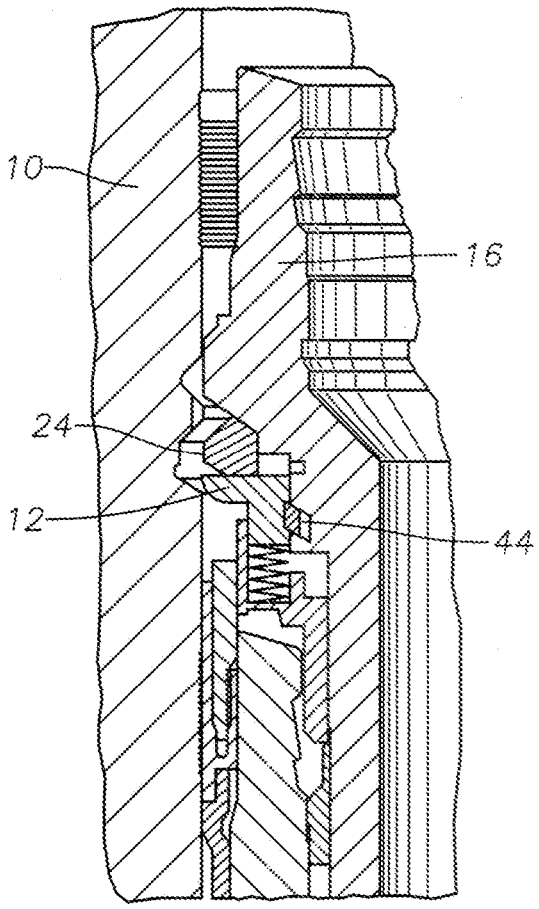

In order to deactivate and remove the casing hanger H when it is landed with the load ring 24 fully set (FIG. 7A), the casing hanger H is lifted until top of load ring 24 contacts wellhead housing in the position shown in FIG. 7B. Further lifting tension or force shears the engagement (FIG. 7C) between the overpull check ring 56 and the ratchet structure 54 on the activation ring 12, allowing the load ring 24 to collapse to a position where the load ring 24 is fully collapsed (FIG. 7D) and it is now possible to pull the casing hanger H out of wellhead housing 10.

The present invention has significant advantages. It provides an improved rate of success due to the capability to accommodate variations in installed height of casing hangers due to cuttings, debris or otherwise. The present invention provides an assembly that is much less sensitive to the presence of cuttings or debris. This permits the well operator more time for drilling operations rather than circulation and hole conditioning operations.

While the invention has been shown in only one of its forms, it should be apparent to those skilled in the art that it is not so limited but is susceptible to various changes without departing form the scope of the invention.

What is claimed is:

1. A wellhead assembly, comprising:

a wellhead housing having a bore with a longitudinal axis therein and an installed lower casing hanger mounted therewith, the wellhead housing having in the bore a load ring groove with an upward and inward facing support shoulder above an upper end of the lower casing hanger, the support shoulder having an inner diameter that is the same as an inner diameter of the bore above the load ring groove;

an upper casing hanger for securing to a string of casing and lowering into the wellhead housing;

an inward-biased split, resilient load ring carried in a retracted initial position on the upper casing hanger, the load ring being movable radically outward to a set position in engagement with the wellhead housing;

an actuator carried with the upper casing hanger below the load ring so that the load ring moves from the initial position toward an expanded position in contact with the wellhead housing when the actuator lands on the lower casing hanger and casing weight is applied to the load ring via the upper casing hanger and the actuator;

the actuator including a resilient, axially compressible mechanism having a compression stiffness greater than a resistance to radial expansion of the load ring so that the actuator expands the load ring before being compressed under the weight of the casing string;

wherein in the event the load ring is pushed into contact with the wellhead housing with the load ring misaligned above the support shoulder, continued lowering of the upper casing hanger causes the compressible mechanism to contact to enable the load ring to move further downward in the wellhead housing and into engagement with the support shoulder of the wellhead housing.

2. The wellhead assembly according to claim 1, wherein the actuator comprises:

an upper activation ring sleeve member;

a lower activation ring sleeve member;

the upper and lower activation ring sleeve members being movable with respect to each other when the upper casing hanger lands on the lower casing hanger; and the compressible mechanism being located between the upper and lower activation ring sleeve members.

3. The wellhead assembly according to claim 1, further including:

a lock ring having a locked and an unlocked position, the lock ring mounted on the upper casing hanger; and the lock ring restraining the actuator from movement relative to the upper casing hanger while in the locked position, permitting movement of the actuator relative to the upper casing hanger while in the unlocked position to enable the casing hanger to move downward relative to the actuator, and being moveable from the unlock position to the locked position for retrieval of the casing hanger.

4. The wellhead assembly according to claim 3, wherein the lock ring is collapsible to unlock under applied downward force from the upper casing hanger after the actuator has landed on the lower casing hanger.

5. The wellhead assembly according to claim 1, further including:

an overpull check ring mounted between the actuator and the upper casing hanger to engage and axially lock the actuator to the upper casing hanger when the load ring is in the expanded position to allow initial upward test force to be applied on the upper casing hanger, the test force passing in a load path through the actuator and the load ring to the wellhead housing to confirm proper landing.

6. The wellhead assembly according to claim 5, wherein the overpull check ring shears in response to an increased upward force larger than the initial upward test force to axially disengage the upper casing hanger from the actuator and allow retraction of the load ring.

7. A method for installing an upper casing hanger atop an installed lower casing hanger in a bore of wellhead housing at the upper end of a well in a body of water, comprising:

(a) providing a load ring groove with a support shoulder in the bore of the wellhead housing above the lower casing hanger;

(b) mounting a split, resilient load ring in an initial position on the upper casing hanger;

(c) mounting an actuator on the upper casing hanger below the load ring, the actuator having an axially compressible mechanism that allows the actuator to axially contract in length from an extended position;

(d) securing a string of casing to the upper casing hanger and lowering the upper casing hanger into the wellhead housing;

(e) landing the actuator on the lower casing hanger;

(f) applying casing string weight to the upper casing hanger to cause the upper casing hanger to move downward relative to the load ring and the actuator to expand the load ring with the actuator into engagement with the load ring groove in the wellhead housing while the actuator is in the extended position; then, in the event the load ring contacts the wellhead housing in a misaligned position in the load ring groove; and (g) compressing the actuator from the extended position with casing string weight to allow the expanded load ring to move downward with the upper casing hanger in the wellhead after the actuator has landed on the lower casing hanger to land the load ring on the support shoulder of the wellhead housing.

8. The method according to claim 7, further comprising:

preventing upward movement of the upper casing hanger to a selected overpull force after the load ring has landed on the support shoulder; and confirming proper engagement of the load ring in the load ring groove by lifting upward on the upper casing hanger to an amount less than the selected overpull force, the upward lifting causing the load ring to bear against an upper surface of the load ring groove.

9. The method according to claim 8, further comprising retrieving the upper casing hanger by lifting upward on the upper casing hanger by an amount greater than the selected overpull force, which shears axial engagement of the actuator with the upper casing hanger, enabling the upper casing hanger to move upward relative to the actuator and the load ring so that the load ring can retract to the initial position.

10. A wellhead assembly, comprising:

a wellhead housing having a bore therein and an installed lower casing hanger mounted therewith, the wellhead housing having in the bore a load ring groove with an upward and inward facing support shoulder above an upper end of the lower casing hanger;

an upper casing hanger for securing to a string of casing and lowering into the wellhead housing, the upper casing hanger having an external downward and outward facing load transfer shoulder;

an inward-biased split, resilient load ring carried in a retracted initial position on the upper casing hanger, the load ring having an upper surface in sliding engagement with the load transfer shoulder;

an upper actuator sleeve carried by the upper casing hanger and having an upper surface in sliding engagement with a lower surface of the load ring, the upper actuator sleeve being axially movable relative to the upper easing hanger;

a lower actuator sleeve carried by the upper casing hanger below the upper actuator sleeve and being axially movable relative to the upper casing hanger, the lower actuator sleeve having a downward facing surface that lands on an upper end of the lower casing hanger;

an axially contractable spring mounted between the upper actuator sleeve and the lower actuator sleeve for urging the upper and the lower actuator sleeves apart from each other; wherein the spring has a greater resistance to contraction than the load ring to expansion, so that when the lower actuator sleeve lands on the lower casing hanger, continued downward movement of the upper casing hanger relative to the upper and lower actuator sleeves causes the load transfer shoulder to push the load ring from the initial position toward an expanded position in contact with the wellhead housing while the spring remains extended; and wherein in the event the load ring is pushed outward into contact with the wellhead housing at a point where the lower surface of the load ring above the support shoulder, continued lowering of the upper casing hanger causes the spring to contract to enable the load ring to move further down ward in the wellhead housing and into engagement with the support shoulder of the wellhead housing.

11. The assembly according to claim 10, wherein:

a maximum outer diameter of the lower actuator sleeve is less than the inner diameter of the bore above the lower casing hanger to enable the lower actuator sleeve to land on the lower casing hanger.

12. The assembly according to claim 10, further comprising:

an overpull check ring located between the upper actuator sleeve and the upper casing hanger that allows downward movement of upper casing hanger relative to upper actuator sleeve and resists upward movement of the upper casing hanger relative to the upper actuator sleeve to enable an operator to perform an overpull test by lifting the upper casing hanger and transferring an upward force on the upper casing hanger through the upper actuator sleeve to the load ring and from the load ring to the load ring groove.

13. The assembly according to claim 12, wherein the overpuil check ring shears at a selected upward force, causing the upward force to move the upper easing hanger upward relative to the upper actuator member to enable the load ring to retract to the retracted initial position for retrieval of the upper casing hanger.

14. The assembly according to claim 13, wherein the overpull check ring engages the upper actuator sleeve to prevent upward movement of the upper casing hanger relative to the upper actuator sleeve only after the lower actuator sleeve has landed on the lower casing hanger and the upper casing hanger has moved downward relative to the upper actuator sleeve.

15. The assembly according to claim 10, further comprising:

mating lock ring grooves on an inner diameter of the upper actuator sleeve and on the upper easing hanger; and a lock ring carried within the lock ring grooves and having a locked position located within both of the lock ring grooves, the lock ring having a released position when within only one of the lock ring grooves.

16. The assembly according to claim 15, wherein the lock ring is located in the locked position while the upper casing hanger is being lowered into the wellhead housing and prior to the lower actuator sleeve landing on the lower casing hanger.

17. The assembly according to claim 10, wherein the upper actuator sleeve has a maximum outer diameter equal to a maximum outer diameter of the upper casing hanger.

18. The assembly according to claim 10, wherein the support shoulder has an inner diameter that is the same as an inner diameter of the bore above the load ring groove.

* * * * *

UNITED STATES PATENT AND TRADEMARK OFFICE

CERTIFICATE OF CORRECTION

PATENT NO. : 8,413,730 B2
APPLICATION NO. : 12/956723
DATED : April 9, 2013
INVENTOR(S) : Gette et al.

It is certified that error appears in the above-identified patent and that said Letters Patent is hereby corrected as shown below:

In the Specifications:

In Column 3, Line 1, delete “10” and insert -- 10. --, therefor.

In the Claims:

In Column 5, Line 27, in Claim 1, delete “contact” and insert -- contract --, therefor.

In Column 6, Line 66, in Claim 10, delete “easing” and insert -- casing --, therefor.

In Column 7, Line 25, in Claim 10, delete “down ward” and insert -- downward --, therefor.

In Column 8, Lines 6-7, in Claim 13, delete “overpuil” and insert -- overpull --, therefor.

In Column 8, Line 8, in Claim 13, delete “easing” and insert -- casing --, therefor.

In Column 8, Line 22, in Claim 15, delete “easing” and insert -- casing --, therefor.

Signed and Sealed this
Sixteenth Day of July, 2013

Teresa Stanek Rea
*Acting Director of the United States Patent and Trademark Office*